United States Patent [19]

Yamaguchi

[11] Patent Number: 4,478,525

[45] Date of Patent: Oct. 23, 1984

[54] MUSICAL ENVELOPE CONTROL DEVICE

[75] Inventor: Tetsuo Yamaguchi, Kawasaki, Japan

[73] Assignee: Tokyo Shibaura Denki Kabushiki Kaisha, Kawasaki, Japan

[21] Appl. No.: 325,868

[22] Filed: Nov. 30, 1981

[30] Foreign Application Priority Data

Dec. 2, 1980 [JP] Japan ..... 55-169850

[51] Int. Cl.[3] ..... G10F 1/00

[52] U.S. Cl. ..... 368/273; 84/1.03; 84/1.26; 84/1.13

[58] Field of Search ..... 368/272, 273; 84/1.03, 84/1.26, 1.13

[56] References Cited

U.S. PATENT DOCUMENTS

| | | | |
|---|---|---|---|
| 3,854,365 | 12/1974 | Tomisawa et al. | 84/1.01 |
| 4,010,667 | 3/1977 | Kniepkamp | 84/1.26 |
| 4,267,586 | 5/1981 | Uchino et al. | 84/1.03 |
| 4,328,731 | 5/1982 | Gotho et al. | 84/1.03 |
| 4,368,989 | 1/1983 | Kawashima | 84/1.03 |

FOREIGN PATENT DOCUMENTS

| | | |
|---|---|---|
| 55-76973 | 6/1980 | Japan . |
| 55-76974 | 6/1980 | Japan . |
| 55-106381 | 8/1980 | Japan . |
| 2004402A | 3/1979 | United Kingdom . |

*Primary Examiner*—Forester W. Isen

*Attorney, Agent, or Firm*—Finnegan, Henderson, Farabow, Garrett & Dunner

[57] ABSTRACT

Disclosed is a musical envelope control device which is used in an electronic watch with a melody alarm function. The musical envelope control device comprises a memory which stores musical performance data representing pitches and durations of notes; an address counter; a pitch divider which receives pitch data and generates a tone signal in correspondence with the pitch data; a note control circuit which receives note duration data, divides the duration into a preset number of components and then generates a coded signal of a predetermined bit length for each duration component; an envelope decoder which is connected to the note control circuit and converts the coded signals to voltage signals in accordance with a predetermined conversion mode corresponding to a desired envelope waveform; and an envelope control circuit which produces a sound pressure signal having a stepped waveform in response to the voltage signal and which generates a sound signal by synthesizing the sound pressure signal and the tone signal.

12 Claims, 5 Drawing Figures

MUSICAL ENVELOPE CONTROL DEVICE

BACKGROUND OF THE INVENTION

The present invention relates to a musical envelope control device, and, more particularly, to a musical envelope control device which is employed for an electronic watch device which produces melody sounds at a predetermined time and which controls the envelope characteristics of the melody sounds.

Recently, digital electronic watches which play various melodies instead of a monotonous alarm sound at predetermined times have become commercially available. These digital electronic watches display the time digitally, and a desired time may be set by the user. A conventional electronic watch with a melody function comprises a memory circuit for storing pitch data and duration data of a melody, a pitch frequency divider and a duration frequency divider which respectively produce a pitch signal and a duration signal according to the pitch data and the duration data, an address counter for specifying a memory address of melody sound data which is stored in the memory circuit, and a speaker means for converting an electric signal to a sound signal, in addition to a known timing circuit. An impedance circuit, corresponding to an envelope waveform producing unit, is further provided for improving the tone quality of the melody produced by a conventional electronic watch to be as real as possible. The impedance circuit, for example, is constituted by a parallel circuit of a capacitor and a resistor. The potential of a melody signal is controlled in accordance with a time constant determined by the capacitance of a capacitor C and the resistance of a resistor R. A continuity characteristic (called a "Release" waveform) is added to the melody signal so that a melody sound having the desired envelope characteristic is produced.

In an electronic watch having an impedance circuit as the conventional envelope waveform shaping unit, only a leading-edge continuity characteristic (Attack-Release characteristic) is accomplished. The envelope waveform of a sound made by a natural musical instrument at the peak of the waveform substantially consists of a leading edge portion (to be referred to as an Attack hereinafter), a trailing edge portion (to be referred to as a Decay hereinafter), a constant portion (to be referred to as a Sustain hereinafter), and a continuous portion (to be referred to as a Release hereinafter). Therefore, a melody which is generated by the conventional electronic watch and only has the Attack-Release characteristic sounds different from a natural sound because of an unnatural tone quality. A waveform of the Release (continuity time) which is added to the melody sound is determined only by the time constant of an impedance circuit. Therefore, a predetermined constant Release waveform is added to the melody sound independently of the tempo of the melody. As a result, an envelope characteristic which corresponds to the tempo of the melody, that is, to the performance speed, cannot be obtained. For example, when the time constant of the impedance circuit is set at a general melody tempo, a melody with an up-tempo may not be produced with clear tone. To the contrary, if the time constant of the impedance circuit is set for a fast tempo, a melody with a slow tempo is interrupted, degrading the tone quality.

SUMMARY OF THE INVENTION

It is an object of the present invention to provide a musical envelope control device in which an envelope characteristic is selected in correspondence with the tempo of the melody to be performed and a melody sound with a desirable natural tone quality is produced.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the musical envelope control device of this invention comprises a memory means for storing a plurality note data including first musical performance data representing note pitch and second musical performance data representing note duration; read-out means for selecting and for reading out the note data from said memory means; first processing means, connected to said memory means, for receiving the first musical performance data and generating a tone signal according to said first musical performance data; second processing means, connected to said memory means, for receiving the second musical performance data and dividing said note duration into a predetermined number of components irrespective of the length of note duration, and generating for each component coded signals which have predetermined bits; decoder means, connected to said second processing means, having a predetermined input/output conversion mode corresponding to a desired envelope waveform, for converting said coded signals in accordance with said input/output conversion mode and for generating voltage signals which vary for the various components of note duration; and envelope control means, connected to said first processing means and said decoder means and receiving the tone signal and the voltage signals, for producing a stepped, sound pressure signal representing a stepped musical envelope waveform whose level changes in a stepped manner in response to changes in the voltage signals, whereby said sound pressure signal and said tone are used to generate a sound signal each note of which has substantially the same envelope waveform irrespective of the duration thereof.

DETAILED DESCRIPTION OF THE PREFERRED EMBODIMENTS

Figure 1:
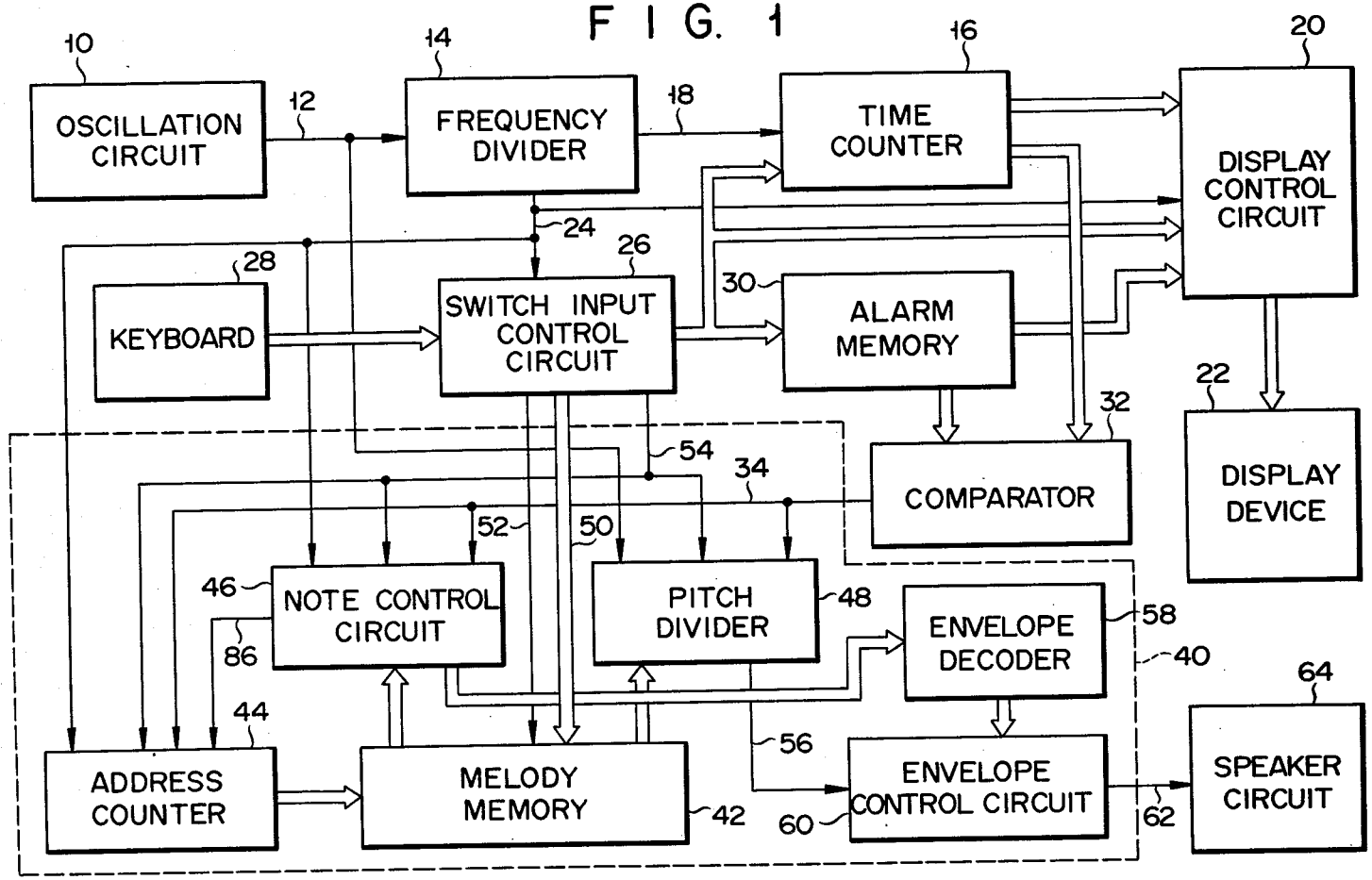
FIG. 1 is a block diagram for illustrating the overall arrangement of an electronic watch of one embodiment of the present invention.

FIG. 1 is a block diagram for illustrating the overall arrangement of an electronic watch with a melody alarm function according to one embodiment of the present invention. Reference numeral 10 denotes an oscillation circuit. The oscillation circuit 10 is arranged to include, for example, a quartz resonator (not shown) and generates a time reference signal 12 of a predetermined frequency, for example, about 32 kHz. An output end of the oscillation circuit 10 is connected through a frequency divider 14 to a time counter 16. The time reference signal 12 is frequency-divided at the frequency divider 14 and is then converted to a time clock signal 18 which is supplied to the time counter 16. The time counter 16 frequency-divides the time clock signal 18 into time units of second, minute and hour, and generates time data. This data is supplied to a display control circuit 20. The display control circuit 20 includes a known arrangement of a decoder (not shown), a display selector (not shown), a driver (not shown) and so on. The display control circuit 20 is connected to a display device 22 which is constituted by, for example, a liquid crystal display (LCD). The time data is digitally and visibly displayed on the display device in numbers designating time.

A frequency dividing signal 24 from a specified dividing step of the frequency divider 14 is supplied as a system control signal to the display control circuit 20, a switch input control circuit 26, an address counter 44 and a note control circuit 46. An input end of the switch input control circuit 26 is connected to an input section, for example, a keyboard 28. An output end of the switch input control circuit 26 is connected to the time counter 16, the display control circuit 20 and an alarm memory 30 which stores an alarm time. In response to the signal from the keyboard 28, the switch input control circuit 26 instructs correction of the time data generated by the time counter 16, instructs an alarm time setting for the alarm memory 30, specifies the display mode of the display device 22, and controls the alarm sound. Alarm time data set by an operator with the keyboard 28 is stored in the alarm memory 30, is transmitted to the display device 22 through the display counter circuit 20, and is visually displayed at the display device 22. Output ends of the time counter 16 and the alarm memory 30 are connected to a comparator 32. The comparator 32 compares time data which is transmitted from the time counter 16 and which corresponds to the current time, and alarm time data which is transmitted from the alarm memory 30. When the time data of the time counter 16 coincides with the alarm time data, the comparator 32 detects this coincidence and generates a predetermined detection signal 34. The detection signal 34 is supplied to a melody control unit 40.

The melody control unit 40 includes a melody memory 42, the address counter 44, the note control circuit 46 and a pitch divider 48. The melody memory 42 is constituted by, for example, a known random acess memory. Stored in the memory 42 are musical performance data representing pitches of notes (to be referred to as pitch data hereinafter) and musical performance data indicating durations of notes (to be referred to as duration data hereinafter) which form a predetermined number of pieces of note information, each of which has a tone name. The melody memory 42 is connected through a data bus 50 to the switch input control circuit 26 which is connected to the keyboard 28. A read/write signal 52 is supplied from the switch input control circuit 26 to the melody memory 42. The duration data and the pitch data can be inputted to the melody memory 42 in response to an operation with the keyboard 28. When the operator sets predetermined duration and pitch data with the keyboard 28, these data are supplied to the melody memory 42 through the data bus 50 and are stored in the melody memory 42. When musical performance is made with the keyboard 28, the switch input control circuit 26 generates a start-up signal 54 which is supplied to the address counter 44, the note control circuit 46 and the pitch divider 48. The start-up signal 54 functions as a count-up signal for the address counter 44.

On the other hand, the detection signal 34 generated by the comparator 32 is supplied to the address counter 44, the note control circuit 46 and the pitch divider 48. The detection signal 34 is used as a melody performance start signal for the address counter 44, and as a reset signal for the note control circuit 46 and the pitch divider 48. When the note control circuit 46 and the pitch divider 48 receive the reset signal 34, the note control circuit 46 and the pitch divider 48 are reset and are restored to the initial condition. When the address counter 44 receives the detection signal 34 as the melody performance start signal, the address counter 44 specifies a memory address for predetermined note information within the melody memory 42. Addresses of the memory memoly 42 which store the duration and pitch data corresponding to a predetermined melody are sequentially designated by the address counter 44. The duration and pitch data, the addresses of which are specified by the address counter 44, which are stored in a memory area of the melody memory 42 are respectively supplied to the note control circuit 46 and the pitch divider 48. The frequency dividing signal 24 which is generated from a predetermined stage of the frequency divider 14 is further supplied to the address counter 44 and note control circuit 46, as shown.

The time reference signal 12 generated by the oscillation circuit 10 is supplied to the pitch divider 48. The pitch divider 48 divides the time reference signal based on a frequency dividing ratio in correspondence with the pitch data which is supplied from the melody memory 42, and generates a pitch frequency signal 56 in correspondence with the pitch. An output end of the note control circuit 46 is connected to an envelope decoder 58. Output ends of the envelope decoder 58 and the pitch divider 48 are connected to an envelope control circuit 60. As connected, the duration data from the note control circuit 46 is supplied to the envelope decoder 58. The duration data is decoded by the envelope decoder 58. The pitch frequency signal 56 from the pitch divider 48 and an output signal from the envelope decoder 58 are supplied to the envelope control circuit 60. The envelope control circuit 60 converts this output signal to a voltage signal, superposes this voltage signal on the pitch frequency signal 56, and produces a melody sound signal 62. The melody sound signal 62 is supplied to a speaker circuit 64 and is converted to an audible sound at the speaker circuit 64.

Figure 2:
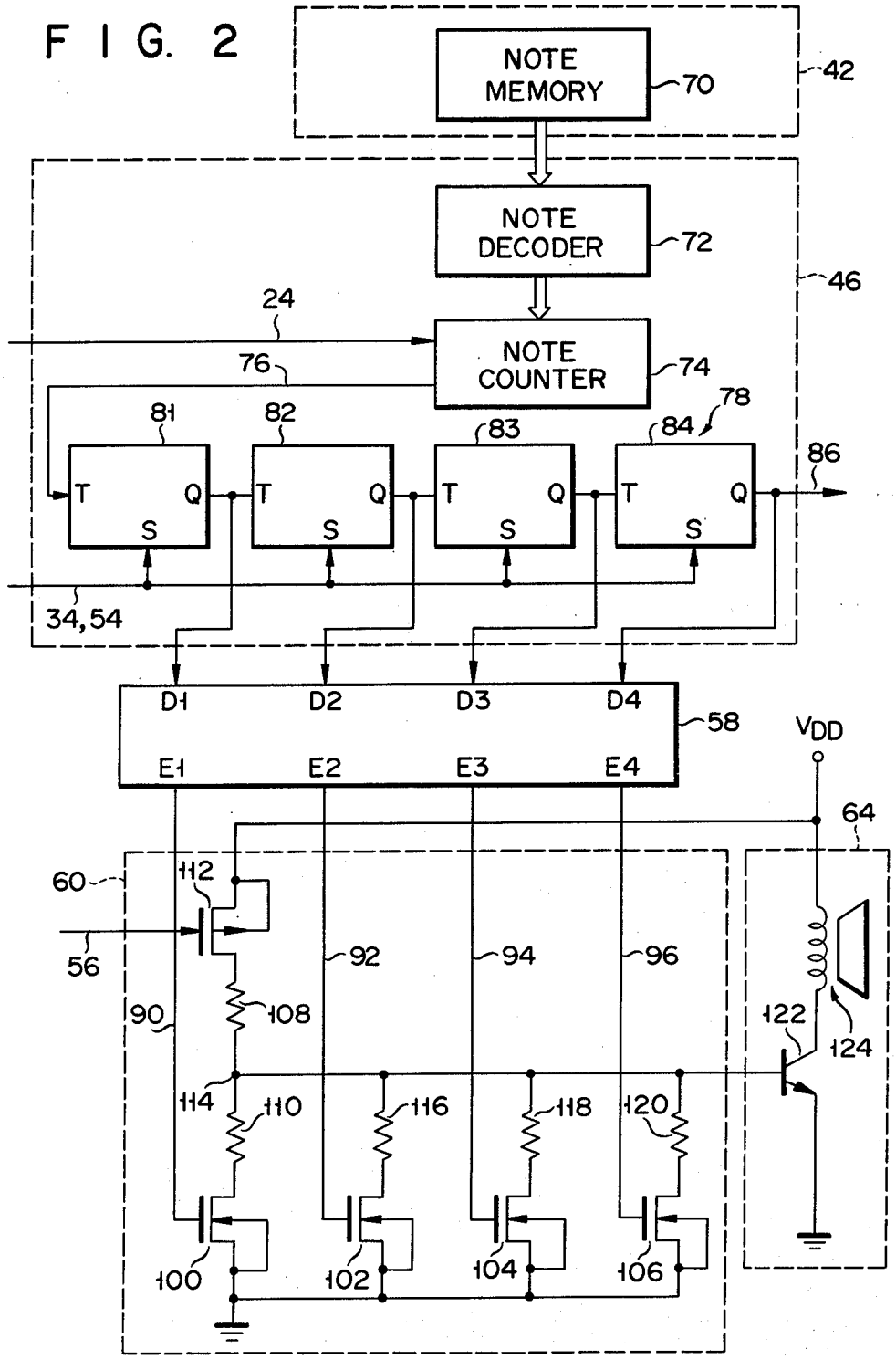
FIG. 2 is a block diagram for illustrating an internal arrangement of a melody control unit of FIG. 1.

FIG. 2 shows a detailed internal arrangement of the melody control unit 40 of FIG. 1. A note memory 70 is arranged within the melody memory 42. Duration data of predetermined length, for example, 4 bits, which is stored in the duration memory 70 is supplied to a note decoder 72 which is arranged within the note control circuit 46. An output end of the note decoder 72 is connected to a note counter 74. The note decoder 72 decodes the duration data which is supplied from the note memory 70.

The note decoder 72 determines an initial value of a 5-bit datum of the note counter 74 and presets a frequency dividing ratio corresponding to this initial value. The note counter 74 is constituted by five-stages of binary counters (not shown) and is set at one of the frequency dividing ratios in the range of 1/32 to 1, for example 1/16, in response to the output signal from the decoder 72. The frequency dividing signal 24 is supplied from the predetermined stage of the frequency divider 14 (FIG. 1) to the note counter 74. The frequency dividing signal 24 functions as the clock signal for the note counter 74. A carry signal 76 output from the note counter 74 is supplied to a binary counter chain 78.

The binary counter chain 78 may be, for example, a counter of 4 bits. Four counters 81, 82, 83 and 84 are connected in series to constitute the binary counter chain 78. Set terminals S of the counters 81, 82, 83 and 84 receive the detection signal (reset-signal) 34 from the comparator 32 (FIG. 1) and the start-up signal generated by the switch input control circuit 26. Output ends Q of the counters 81, 82, 83 and 84 are respectively connected to first to fourth input ends D1 to D4 of the envelope decoder 58. The output end Q of the counter 84 of the last stage is connected to the address counter 44 (FIG. 1). Therefore, an output signal from the counter 84 of the fourth stage is supplied to the address counter 44 as an address increment signal 86.

The envelope decoder 58 decodes each output signal (Q output) from the counters 81, 82, 83 and 84 and outputs four decoded signals to signal lines 90, 92, 94 and 96 from four output ends E1, E2, E3 and E4. The input/output characteristics of the envelope decoder 58 are shown in the table below:

TABLE I

| Input Value | | | | | Output Value | | | |
|---|---|---|---|---|---|---|---|---|
| D1 | D2 | D3 | D4 | Voltage Step | E1 | E2 | E3 | E4 |
| 1 | 1 | 1 | 1 | 0 | 0 | 0 | 0 | 0 |
| 0 | 1 | 1 | 1 | 1 | 1 | 0 | 0 | 0 |
| 1 | 0 | 1 | 1 | 2 | 0 | 1 | 0 | 0 |
| 0 | 0 | 1 | 1 | 3 | 1 | 1 | 0 | 0 |
| X | X | 0 | 1 | 3 | 1 | 1 | 0 | 0 |
| X | 1 | 1 | 0 | 4 | 0 | 0 | 1 | 0 |
| 1 | 0 | 1 | 0 | 5 | 0 | 1 | 1 | 0 |
| 0 | 0 | 1 | 0 | 7 | 1 | 1 | 1 | 0 |
| 1 | 1 | 0 | 0 | 9 | 1 | 0 | 0 | 1 |
| 0 | 1 | 0 | 0 | 11 | 1 | 0 | 1 | 1 |
| 1 | 0 | 0 | 0 | 13 | 1 | 0 | 1 | 1 |
| 0 | 0 | 0 | 0 | 15 | 1 | 1 | 1 | 1 |

Where, the "X" mark indicates "Don't Care".

The first to fourth output ends E1, E2, E3 and E4 of the envelope decoder 58 are connected to gate electrodes of first to fourth switching transistors for example n-channel MOSFETs 100, 102, 104 and 106, through the signal lines 90, 92, 94 and 96. The first to fourth switching transistors 100, 102, 104 and 106 are included in the envelope control circuit 60. A drain electrode of the first switching transistor 100 is connected to a drain electrode of a p-channel MOSFET 112 through first and second resistors 108 and 110. The pitch frequency signal 56 generated by the pitch divider 48 is supplied to a gate electrode of the MOSFET 112. A predetermined power source voltage (positive voltage) $V_{DD}$ is supplied to a source electrode of the p-channel MOSFET 112. A common node 114 between the first and second resistors 108 and 110 is connected to drain electrodes of the second, third and fourth n-channel MOSFETs 102, 104 and 106, respectively, through third, fourth and fifth resistors 116, 118 and 120. Source electrodes of the first to fourth n-channel MOSFETs 100, 102, 104 and 106 are grounded. If the resistances of the first to fifth resistors 108, 110, 116, 118 and 120 are defined as R1, R2, R3, R4 and R5, respectively, the ratio among the resistances is, for example, set as follows:

$$R1:R2:R3:R4:R5 = 1:8:4:2:1$$

The common node 114 between the first and second resistors 108 and 110 of the envelope control circuit 60 is connected to a base electrode of an npn transistor 122 for driving a speaker. The npn transistor 122 is included in the speaker circuit 64. A collector electrode of the npn transistor 122 is connected to one end of a speaker 124, and an emitter electrode of the npn transistor 122 is grounded. The power source voltage $V_{DD}$ is supplied to the other end of the speaker 124.

The mode of operation of the musical envelope control device according to one embodiment of the present invention will be described. When a predetermined alarm time is reached whose data was entered by the operator with the keyboard 28 and is stored within the alarm memory 30, the detection signal 34 is generated by the comparator 32. In response to the detection signal 34, the address counter 44 starts operating. A duration datum specified by the address counter 44 among the data stored in the note memory 70 of the melody memory 42 is read out and transmitted to the note control circuit 46. At the same time, a pitch datum which is specified by the address counter 44 among the pitch data stored in the melody memory 42 is read out and transmitted to the pitch divider 48. The duration datum is constituted by a digitally coded datum, for example, a 4-bit datum. A half note corresponds to "0001", a quarter note corresponds to "0010" and an eighth note corresponds to "0011".

The duration datum which is supplied from the note memory 70 of the melody memory 42 to the note decoder 72 of the note control circuit 46 is decoded by the note decoder 72 and is converted to a preset datum of, for example, 5 bits. This converted datum is supplied to the note counter 74. When a code "0001" which designates a half note is output from the note memory 70, a decoded signal "10000" is generated as the preset datum from the note decoder 72. When a code "0010" which designates a quarter note is generated, a preset datum "11000" is generated. Furthermore, when a code "0011" which designates an eighth note is generated, a preset datum "11100" is generated. These preset data are sequentially set in the note counter 74. Assume that the code "10000" which designates the half note is set in the note counter 74 first. The note counter 74 increments the preset data in response to the frequency dividing signal 24 which is generated from the predetermined stage of the frequency divider 14. In other words, the frequency dividing signal 24 is divided twice during the period until the carry signal 76 is output from the note counter 74, that is, during 1/16 of the period which corresponds to the duration data. When the preset code "11000" which designates the quarter note is set in the note counter 74, the frequency dividing signal 24 is divided into fourths. When the preset code "11100" which designates the eighth note is set in the note counter 74, the frequency dividing signal 24 is divided into eighths.

The binary counter chain 78 of the note control circuit 46 is reset at an initial value of "1111" by the detection signal 34 which is generated by the comparator 32.

The count value of the binary counter chain 78 is incremented by the carry signal 76 which is transmitted from the note counter 74. When the binary counter 78 is reset at the initial value "1111", the initial value data "1111" is decoded by the envelope decoder 58 based on Table I. As a result, an output datum "0000" is produced from the first to fourth output ends E1, E2, E3 and E4 of the envelope decoder 58. This output datum "0000" of four bits is supplied to the gate electrodes of the n-channel MOSFETs 100, 102, 104 and 106. Therefore, the n-channel MOSFETs 100, 102, 104 and 106 are rendered nonconductive. A voltage which is substantially equivalent to the power source voltage $V_{DD}$ is applied to the base electrode of the npn transistor 122 for driving the speaker 124 of the speaker circuit 64. In this condition, the pitch frequency signal 56 which corresponds to the pitch data generated by the pitch divider 48 is supplied to the gate electrode of the p-channel MOSFET 112. Therefore, the pitch frequency signal which has substantially the same voltage level as the power source voltage $V_{DD}$ is supplied to the speaker circuit 64 for a period 1/16 the duration. The output voltage of the envelope control circuit 60 and the voltage ratio of the output voltage thereof to the power source voltage $V_{DD}$ for each voltage step is shown in Table II below:

TABLE II

| Voltage Step | Voltage Ratio ($V_{OUT}/V_{DD}$) |
|---|---|
| 0 | 1.00 |
| 1 | 0.89 |
| 2 | 0.80 |
| 3 | 0.73 |
| 4 | 0.67 |
| 5 | 0.62 |
| 6 | 0.57 |
| 7 | 0.53 |
| 8 | 0.50 |
| 9 | 0.47 |
| 10 | 0.44 |
| 11 | 0.42 |
| 12 | 0.40 |
| 13 | 0.38 |
| 14 | 0.36 |
| 15 | 0.35 |

Figure 3:
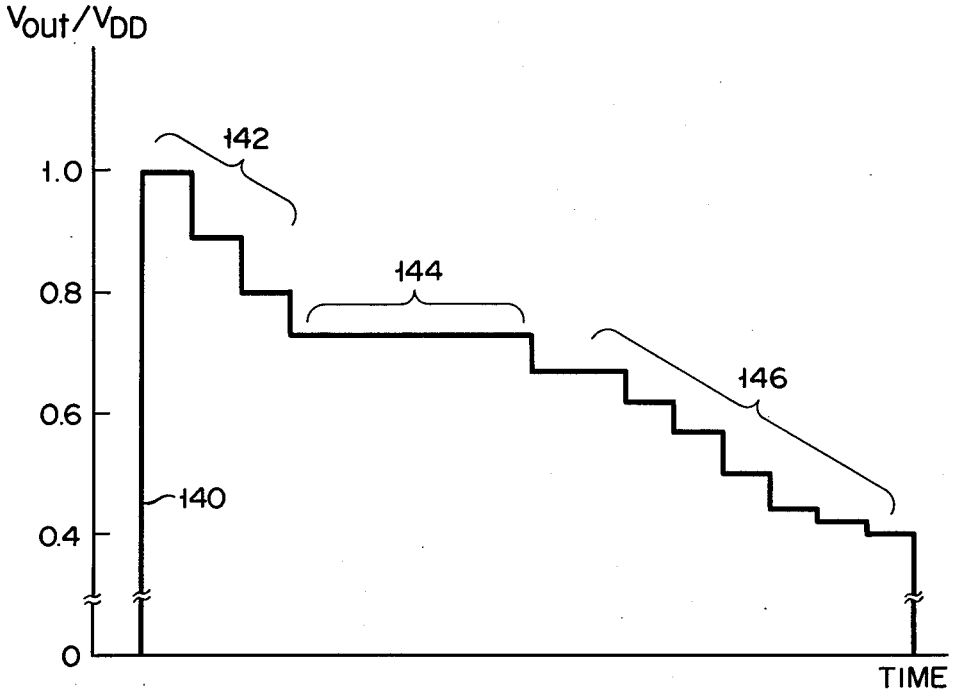
FIG. 3 shows a waveform for explaining a sound signal produced in accordance with the first embodiment of FIGS. 1 and 2.
Figure 4:
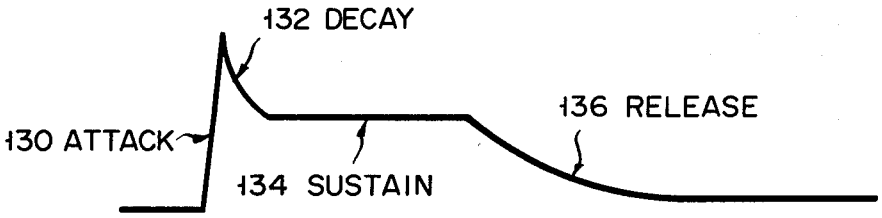
FIG. 4 shows a waveform of a typical natural sound produced by a musical instrument.

When the carry signal 76 is generated by the note counter 74, the preset data is reset in the note counter 74 by the note decoder 72, then the mode of operation as described above is repeated. When the next carry signal 76 is supplied to the binary counter chain 78, the code data "0111" is counted at the binary counter chain 78. The code data "0111" is supplied to the envelope decoder 58. The output data "1000" corresponding to the input data "0111" is produced by the envelope decoder 58 in accordance with Table I. This output data "1000" is supplied from the first to fourth output ends E1, E2, E3 and E4 of the envelope decoder 58 to the gate electrodes of the first to fourth n-channel MOSFETs 100, 102, 104 and 106, respectively. Therefore, only the first n-channel MOSFET 100 which receives a signal "1" is rendered conductive, while the second, third and fourth n-channel MOSFETs 102, 104 and 106 remain nonconductive. In this condition, the voltage ratio of the output voltage $V_{OUT}$ of the envelope control circuit 60 to the power source voltage $V_{DD}$ is 0.89 (voltage step 1) according to Table II. A voltage which is 0.89 times the power source voltage $V_{DD}$ is applied to the speaker circuit 64 for a period 1/16 the duration. The same mode of operation is repeated. For example, as shown in FIG. 3, a waveform having the melody sound signal 62 of stepped envelope for "one note" is transmitted to the speaker circuit 64. The transmitted signal is then converted to sound by a known method. FIG. 4 shows a typical envelope for natural sound generated from a musical instrument or the like. The envelope of the natural sound has an Attack 130, a Decay 132, a Sustain 134 and a Release 136. When the envelope obtained by the present invention as shown in FIG. 3 is compared with the envelope of the natural sound as shown in FIG. 4, a waveform portion 140 corresponds to the Attack 130 of FIG. 3. Other waveform portions 142, 144 and 146 respectively correspond to the Decay 132, the Sustain 134 and the Release 136.

When the binary counter 78 is sequentially incremented and the count value of the binary counter 78 is finally set to "0000", the binary counter 78 generates the address increment signal 86. The address increment signal 86 is supplied to the address counter 44 so that "1" is added to the count value of the address counter 44. As a result, duration data and pitch data which correspond to a note to be subsequently performed are read out from the melody memory 42 and the readout data are supplied to the note control circuit 46 and the pitch divider 48 in the same manner as described above. The envelope operation for this new note is substantially the same as described above and the detailed description thereof is omitted.

In the musical envelope control device with the above arrangement and the above-mentioned mode of operation according to the present invention, the envelope having the Attack, Decay, Sustain and Release may be imposed on an original melody. Therefore, a melody sound with high tone quality which is similar to natural sound may be generated. Further, the envelope described above may be arbitrarily controlled by the envelope decoder 58. For a plurality of songs with different tempos, data of which are stored in the melody memory 42, each optimal envelope is selected for the tempo of each song. Furthermore, an envelope which satisfies a listener's taste may also be selected arbitrarily, accomplishing a variety of melody sounds.

According to the present invention, accessory components which constitute the impedance circuit are not required as opposed to the conventional music envelope control device, and the circuit arrangement is formed on one chip, saving space and reducing size and manufacturing cost. Especially since wrist watches with the alarm function must be small in size, light in weight and low in cost, the present invention is suitably employed for this purpose. Furthermore, according to the present invention, when the resistance of a resistor for turning on a switching transistor is set at a negligible level in comparison with the resistances of the resistors 108, 110, 116, 118 and 120, variation of the transistor characteristics in mass production may be neglected. When the resistors described above are also arranged in an integrated circuit, variation among the components is greatly reduced. Even if the absolute values of the resistors vary, relative variation among the respective resistors is small, accomplishing stable operating charcteristics. Therefore, high reliability of the musical envelope control device is improved.

Although the present invention has been shown and described with respect to a particular embodiment, nevertheless, various changes and modifications which are obvious to a person skilled in the art to which the present invention pertains are deemed to lie within the spirit, scope and contemplation of the present invention.

Figure 5:
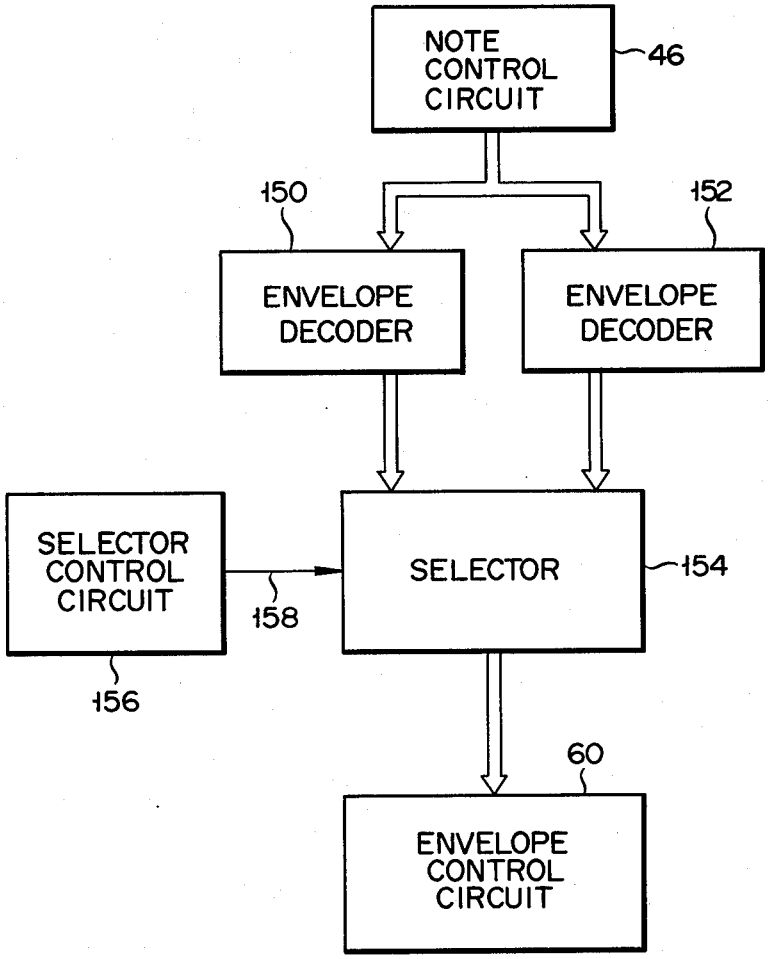
FIG. 5 is a block diagram for illustrating an arrangement for using two envelope decoders according to another embodiment of the present invention.

In the above embodiment, one envelope decoder is included. However, as shown in FIG. 5, two envelope decoders 150 and 152 may be arranged in place of the single envelope decoder. The first and second envelope decoders 150 and 152 which have different envelope characteristics may be connected with an output end of the note control circuit 46 parallel with each other. The envelope decoders 150 and 152 are connected to a selector 154. The operating mode of the selector 154 is controlled by a select signal 158 which is generated from a selector control circuit 156 connected to the selector 154. The duration data which is generated by the note control circuit 46 is simultaneously supplied to the first and second envelope decoders 150 and 152. Waveforms of different envelope characteristics are given by the first and second envelope encoder 150 and 152 and are selectively transmitted to the envelope control circuit 60. In the musical envelope control device with this arrangement, different envelope characteristics may be added to one song in accordance with the listener's requirements as needed.

Furthermore, in the embodiment (FIGS. 1 and 2) described above, sounds which are similar to the typical sounds of a musical instrument having a cycle of Attack, Decay, Sustain, and Release are generated with the arrangement according to the embodiment of the present invention. However, the present invention is not limited to this. An envelope characteristic which only includes a cycle of Attack and Release may be selected, or an envelope characteristic which repeats the Attack may be selected, to give an echo effect to the melody sounds.

What is claimed is:

1. A musical envelope control device comprising:

(a) memory means for storing a plurality of note data including first musical performance data representing note pitch and second musical performance data representing note duration;

(b) read-out means for selecting and for reading out the note data from said memory means;

(c) first processing means, connected to said memory means, for receiving the first musical performance data and generating a tone signal according to said first musical performance data;

(d) second processing means, connected to said memory means, for receiving the second musical performance data and dividing said note duration into a predetermined number of components irrespective of the length of note duration, and generating for each component a coded signal comprising a plurality of bits;

(e) decoder means, connected to said second processing means, having a predetermined input/output conversion mode corresponding to a desired envelope waveform, for converting said coded signals in accordance with said input/output conversion mode and for generating voltage signals which vary for the various components of note duration; and (f) envelope control means, connected to said first processing means and said decoder means and receiving the tone signal and the voltage signals, for producing a stepped, sound pressure signal representing a stepped musical envelope waveform whose level changes in a stepped manner in response to changes in the voltage signals, whereby said sound pressure signal and said tone signal are used to generate a sound signal, each note of which has substantially the same envelope waveform irrespective of the duration thereof.

2. A musical envelope control device according to claim 1, wherein said first processing means receives a predetermined reference signal, and generates the tone signal in correspondence with note pitch data by dividing the reference signal in response to the first musical performance data read out from said memory means.

3. A musical envelope control device according to claim 1, wherein said decoder means is arranged so as to match its conversion modes with various envelope characteristics.

4. A musical envelope control device according to claim 1, wherein said second processing means comprises:

(a) duration decoder means, connected to said memory means, for decoding the duration of each note in the second musical performance data which is supplied from said memory means and for determining a frequency dividing ratio corresponding to the first musical performance data, (b) duration counter means, connected to said duration decoder means, for dividing note duration into a predetermined number of components in accordance with the frequency dividing ratio and for generating a carry signal in response to the dividing operation, and (c) binary counter means, connected to said duration counter means, comprising a predetermined number of counter stages connected in series, for counting said carry signal and outputting from said counter stages bit signals which constitute the coded signals corresponding to the components of note duration.

5. A musical envelope control device according to claim 1, wherein said memory means, said read-out means, said first and second processing means, said decoder means and said envelope control means are integrated on one chip substrate.

6. A musical envelope control device according to claim 1, wherein said envelope control means is supplied with a predetermined power source voltage and produces a stepped sound pressure signal by decreasing the power source voltage in response to changes in the voltage signals from said decoder means.

7. A musical envelope control device according to claim 6, wherein said envelope control means has a plurality of switching means, provided between ground and a line to which the power source voltage is applied, for performing a switching operation in response to the voltage signal supplied from said decoder means, and resistor means which are respectively connected at one end to said switching means and which have resistances so as to form a predetermined resistance ratio among said resistor means, the other ends of said resistor means being connected to an output terminal of said envelope control means; and each of said switching means independently performs the switching operation in response to the voltage signal so that voltage components lower than the power source voltage and corresponding to each resistance are generated at the other ends of said resistor means connected to said switching means, respectively, the voltage components being added together and used with the tone signal to form the sound signal generated from the output terminal of said envelope control means.

8. A musical envelope control device according to claim 7, wherein said switching means are constituted by transistors.

9. A musical envelope control device according to claim 1, wherein a plurality of said decoder means are respectively arranged so as to correspond to different envelope characteristics in response to predetermined conversion modes and are connected to said second processing means parallel with each other, so that different voltage signals which are generated by said decoder means are selectively supplied to said envelope control means.

10. An electronic watch which automatically plays a melody to indicate a preset time, said electronic watch comprising:

(a) an oscillation circuit for generating a time reference signal;

(b) frequency dividing means for dividing the time reference signal which is generated by said oscillation circuit;

(c) time counter means, connected to said frequency dividing means, for performing counting in accordance with a frequency dividing signal and for outputting current time data;

(d) first memory means for storing alarm time data specified by an operator;

(e) comparator means, connected to said time counter means and said first memory means, for comparing the current time data which is output by said time counter means and the alarm time data which is stored in said first memory means and for generating a predetermined detection signal when the current time data and the alarm time data coincide;

(f) second memory means for storing a plurality of note data including first musical performance data representing note pitch and second musical performance data representing note duration;

(g) read-out means responsive to the detection signal for selecting and for reading out the note data from said memory means;

(h) first processing means, connected to said memory means, for receiving the first musical performance data and generating a tone signal according to said first musical performance data;

(i) second paragraph means, connected to said memory means, for receiving the second musical performance data and dividing said note duration into a predetermined number of components irrespective to the length of note duration, and generating for each component a coded signal comprising a plurality of bits;

(j) docoder means, connected to said second processing means, having a predetermined input/output conversion mode corresponding to a desired envelope waveform, for converting said coded signals in accordance with said input/output conversion mode and for generating voltage signals which vary for the various components of note duration;

(k) envelope control means, connected to said first processing means and said decoder means and receiving the tone signal and the voltage signals, for producing a stepped, sound pressure signal representing a stepped musical envelope waveform whose level changes in a stepped manner in response to changes in the voltage signals, whereby said sound pressure signal and said tone signal are used to generate a sound signal, each note of which has substantially the same envelope waveform irrespective of the duration thereof; and (l) speaker means, connected to said envelope control means, for receiving the sound signal and for converting the sound signal to an audible sound.

11. A musical envelope control device according to claim 10, wherein said second processing means comprises:

(a) duration decoder means, connected to said memory means, for decoding the duration of each note in the second musical performance data which is supplied from said memory means and for determining a frequency dividing ratio corresponding to the first musical performance data, (b) duration counter means, connected to said duration decoder means, for divising note duration into a predetermined number of components in accordance with the frequency dividing ratio and for generating a carry signal in response to the dividing operations, and (c) binary counter means, connected to said duration counter means, comprising a predetermined number of counter stages connected in series, for counting said carry signal and outputting from said counter stages bit signals which constitute the coded signal corresponding to the components of note duration.

12. A musical envelope control device according to claim 10, wherein said envelope control means has a plurality of switching means, provided between ground and a line to which the power source voltage is applied, for performing a switching operation in response to the voltage signal supplied from said decoder means, resistor means which are respectively connected at one end to said switching means and which have resistances so as to form a predetermined resistance ratio among said resistor means, the other ends of said resistor means being connected to an output terminal of said envelope control means; and each of said switching means independently performs the switching operation in response to the voltage signal so that voltage components lower than the power source voltage and corresponding to each resistance are generated at the other ends of said resistor means connected to said switching means, respectively, the voltage components being added together and used with the tone signal to form the sound signal generated from the output terminal of said envelope control means.

* * * * *